US009890923B2

(12) United States Patent
Wang

(10) Patent No.: US 9,890,923 B2
(45) Date of Patent: Feb. 13, 2018

(54) LED LAMP ASSEMBLY AND REFLECTIVE LED SEARCHLIGHT USING THE SAME

(71) Applicant: Mao-Shen Wang, New Taipei (TW)

(72) Inventor: Mao-Shen Wang, New Taipei (TW)

( * ) Notice: Subject to any disclaimer, the term of this patent is extended or adjusted under 35 U.S.C. 154(b) by 96 days.

(21) Appl. No.: 15/191,674

(22) Filed: Jun. 24, 2016

(65) Prior Publication Data

US 2017/0002996 A1 Jan. 5, 2017

(30) Foreign Application Priority Data

Jul. 1, 2015 (TW) ..... 104210647 U

(51) Int. Cl.

| | |
|---|---|
| ***F21V 5/04*** | (2006.01) |
| ***F21V 29/76*** | (2015.01) |
| ***F21V 19/00*** | (2006.01) |
| ***F21V 7/06*** | (2006.01) |
| ***F21S 8/00*** | (2006.01) |
| ***F21V 14/06*** | (2006.01) |
| ***F21V 21/30*** | (2006.01) |
| ***F21V 31/00*** | (2006.01) |
| *F21Y 115/10* | (2016.01) |

(52) U.S. Cl.

CPC ..... *F21V 5/04* (2013.01); *F21S 8/003* (2013.01); *F21V 7/06* (2013.01); *F21V 14/06* (2013.01); *F21V 19/003* (2013.01); *F21V 21/30* (2013.01); *F21V 29/76* (2015.01); *F21V 31/00* (2013.01); *F21Y 2115/10* (2016.08)

(58) Field of Classification Search

CPC ... F21V 5/04; F21V 29/76; F21V 7/06; F21V 14/06; F21V 19/003; F21V 21/30; F21V 31/00; F21V 7/0083; F21V 7/04; F21V 13/02; F21V 13/04; F21V 14/02; F21V 21/14; F21V 7/00; F21V 7/0066; F21S 8/003; F21Y 2115/10

See application file for complete search history.

(56) References Cited

U.S. PATENT DOCUMENTS

| | | | | |
|---|---|---|---|---|
| 9,255,687 | B2 * | 2/2016 | Gebhard | F21V 5/04 |
| 9,765,945 | B2 * | 9/2017 | Scordino | F21V 7/06 |
| 2012/0162983 | A1 * | 6/2012 | Pickholz | F21S 48/328 362/235 |

* cited by examiner

*Primary Examiner* — Bao Q Truong

(74) *Attorney, Agent, or Firm* — Bacon & Thomas, PLLC

(57) ABSTRACT

An LED lamp assembly includes LED circuit boards having LEDs as light sources, and concave parabolic lens surfaces as light condensing surface to replace convex lens surfaces having been conventionally used for LED light sources as well as to allow the LED circuit boards to be deposited at sites where is so well air ventilation that heat generated thereby is dissipated rapidly to ensure good heat dissipation for the LED circuit boards; and a reflective LED searchlight comprises the LED lamp assembly as an essential component and features a good heat dissipation for its LED circuit boards.

9 Claims, 5 Drawing Sheets

LED LAMP ASSEMBLY AND REFLECTIVE LED SEARCHLIGHT USING THE SAME

BACKGROUND OF THE INVENTION

1. Field of the Present Invention

The present invention relates to searchlights, and more particularly to a reflective LED searchlight.

2. Description of Related Art

As shown in FIG. 1, a conventional searchlight 11 is a versatile searchlight supporting vertical and horizontal adjustment of its illumination angle. The searchlight 11 includes a lamp holder housing 12, a supporting seat 13 pivotally supporting the lamp holder housing 12 from below, and a lamp assembly 15 pivotally installed in the lamp holder housing 12.

Therein, the lamp assembly 15 is configured to tilt up and down with respect to the lamp holder housing 12 so as to change the illumination angle of the searchlight 11 vertically. The lamp holder housing 12 and the lamp assembly 15 can rotate horizontally in both directions with respect to the supporting seat 13, so as to change the illumination angle of the searchlight 11 horizontally.

As shown in FIG. 1 and FIG. 2, the lamp assembly 15 uses LEDs as light sources, and has a condensing lens 16 and an LED circuit board 18. The condensing lens 16 has a plurality of convex lens surfaces 17, and the LED circuit board 18 has a plurality of LEDs 19 that are quantitatively corresponding to the convex lens surfaces 17 of the condensing lens 16. When assembled, the condensing lens 16 is located in front of the LED circuit board 18, so that the LEDs 19 of the LED circuit board 18 are located at the focuses of the convex lens surfaces 17.

When the searchlight 11 is turned on, the LEDs 19 of the lamp assembly 15 emit light, the light is then condensed by the convex lens surfaces 17 of the condensing lens 16, and projected as parallel beams far in front.

The lamp assembly 15, nevertheless, has its weakness. Since the LEDs 19 of the LED circuit board 18 are sealed in the narrow space defined by the convex lens surfaces 17 of the condensing lens 16, the heat generated from the LEDs 19 if lighted is hardly dissipated, and this may lead to overheat and failure of the LED circuit board 18 of the lamp assembly 15.

SUMMARY OF THE INVENTION

In view of this, it is an object of the invention to provide an LED lamp assembly, which at least comprises concave parabolic lens surfaces to replace convex lens surfaces having been conventionally used for LED light sources for a long time, and LED circuit boards containing a plurality of LEDs for illumination and each LED located at its corresponding focus of the concave parabolic lens surfaces; and more particularly, it is a specific configuration of the LED lamp assembly which allows the LED circuit boards to be deposited at sites where is so well air ventilation that heat generated thereby can be dissipated rapidly, so as to ensure good heat dissipation for the LED circuit boards, and in turn ensure good function over long-term use.

It is another object of the invention to provide an LED lamp assembly comprising:

a lamp casing, containing therein a recess whose upper edge portion and lower edge portion are each provided with a plurality of clamping blocks;

two LED circuit boards, each provided with a plurality of LEDs, wherein one of the LED circuit board is fixed by the clamping block at the upper edge portion of the recess of the lamp casing, and the other LED circuit board is fixed by the clamping block at the lower edge portion of the recess of the lamp casing;

a reflective lens, being a concave parabolic lens surface and having at least one set of double parabolic lens units, wherein each said set of double parabolic lens unit includes a first parabolic lens surface and a second parabolic lens surface integrated as a unity, and each said set of double parabolic lens unit has a slit located at a focus of each of the first parabolic lens surface and the second parabolic lens surface, so that after assembled, each said LED of the LED circuit boards is exposed at one said slit at the corresponding double parabolic lens unit;

a lens frame, having a lens to close the recess of the lamp casing; and an outer frame, enclosing to the lens of the lens frame as well as allowing the lens frame and the outer frame being fixed to the lamp casing together.

It is still another object of the invention to provide an LED lamp assembly comprising a lamp casing which has its top and/or bottom provided with plural heat-dissipating ribs.

It is another primary object of the invention to provide a reflective LED searchlight using the disclosed LED lamp assembly as an essential component of light source.

The disclosed LED lamp assembly and a reflective LED searchlight using the LED lamp assembly have the following advantages:

1. The concave parabolic lens surfaces condense the light embittered by the LED light sources into parallel LED light beams that can be projected or emitted far in front; and
2. The lens frame protects the LED circuit boards from moisture and the LED circuit boards are provided with better heat dissipation, so the lamp assembly is durable for long-term use.

DETAILED DESCRIPTION OF THE PREFERRED EMBODIMENT

Figure 1:
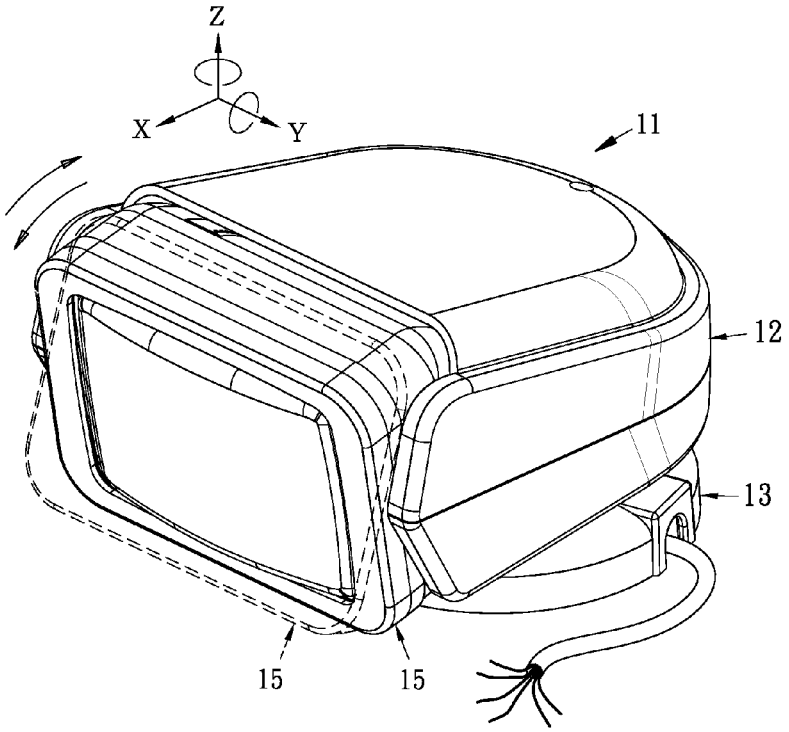
FIG. 1 (prior art)
FIG. 1 is a schematic drawing of a conventional searchlight.
Figure 2:
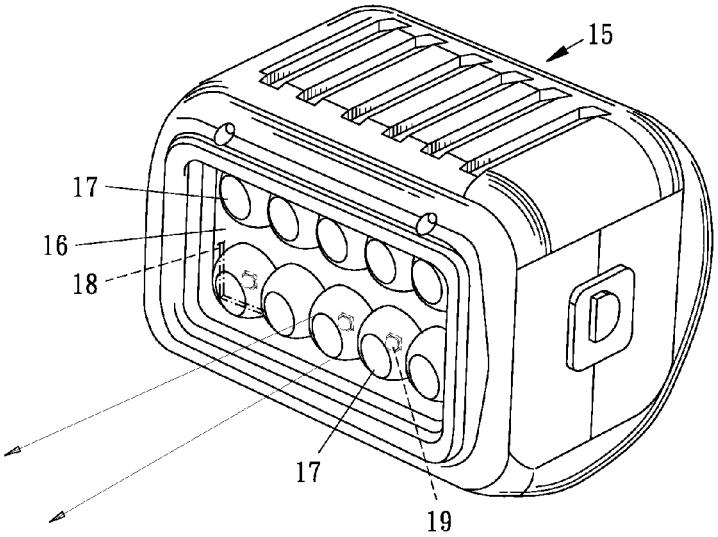
FIG. 2 (prior art)
FIG. 2 is a perspective view of a lamp assembly used in the searchlight of FIG. 1.
Figure 3:
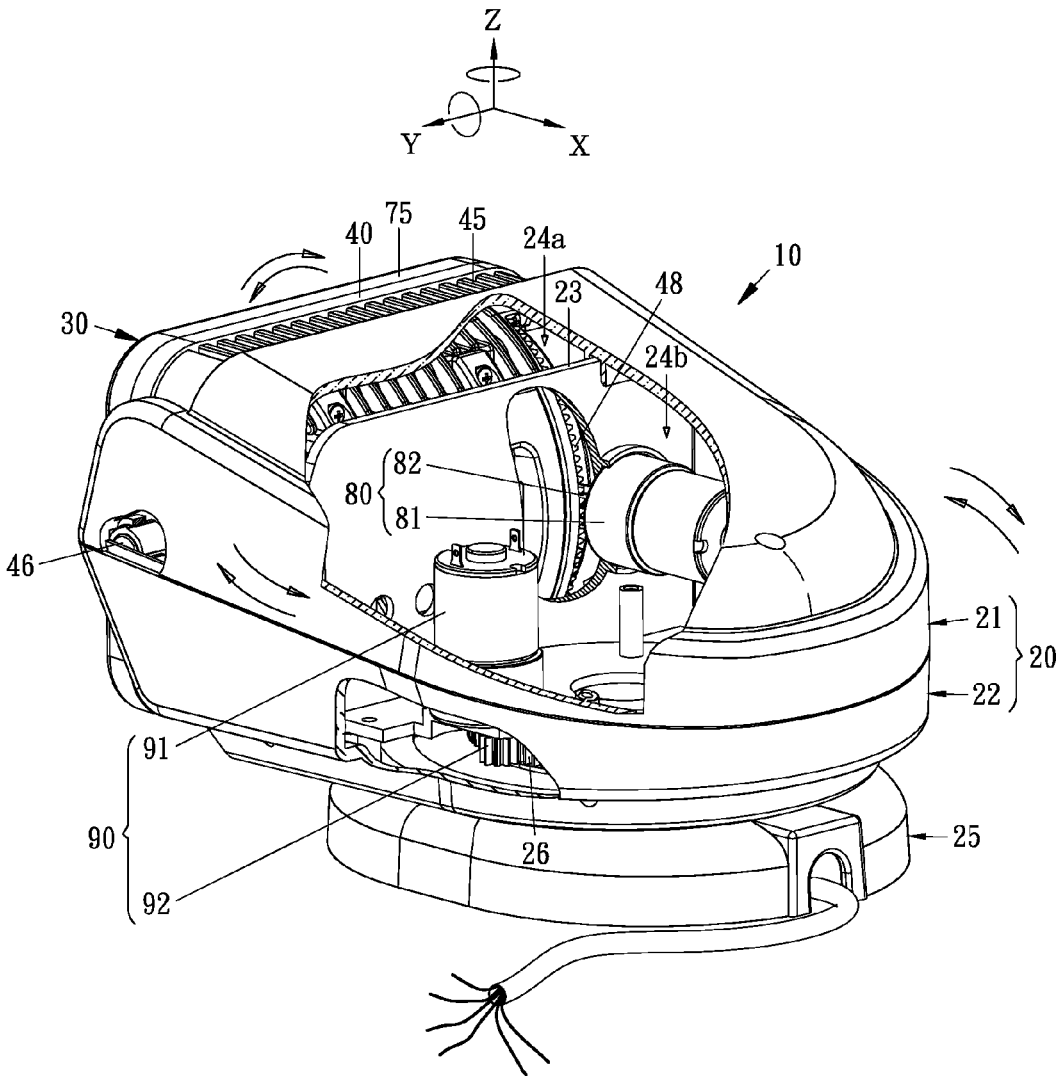
FIG. 3 is a cut-away perspective view of a reflective LED searchlight of the present invention.
Figure 4:
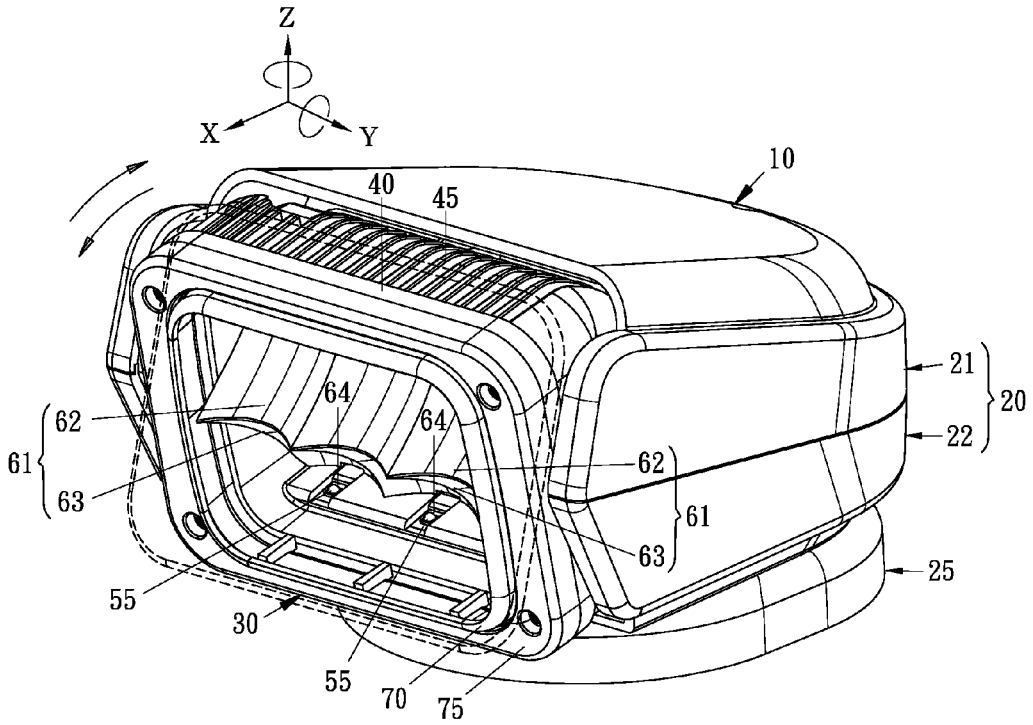
FIG. 4 is a schematic drawing of the reflective LED searchlight of the present invention.

Referring to FIG. 3 and FIG. 4, according to the present invention, a reflective LED searchlight 10 (hereinafter referred to as the LED searchlight 10) is a versatile searchlight with its illumination angle vertically and horizontally adjustable.

The LED searchlight 10 comprises a lamp holder housing 20, a supporting seat 25 pivotally supporting the lamp holder housing 20 from below, and an LED lamp assembly 30

(hereinafter referred to as the lamp assembly 30) pivotally installed in the lamp holder housing 20.

As shown in FIG. 3 and FIG. 4, the lamp holder housing 20 is composed of an upper half 21 and a lower half 22. The lamp holder housing 20 contains therein a partition 23, a stationary gear 26, a vertical driving device 80 and a horizontal driving device 90. Therein, the partition 23 divides the interior of the lamp holder housing 20 into a lamp compartment 24*a* and a machine compartment 24*b*.

As further shown in FIG. 3 through FIG. 8, the lamp assembly 30 comprises a lamp casing 40, two LED circuit boards 50, a reflective lens 60, a lens frame 70 and an outer frame 75.

The lamp casing 40 of the lamp assembly 30 may have its back optionally equipped with a circular rack 48 according to practical needs. The lamp casing 40 may also have its right and left laterals each optionally equipped with a pivot 46 according to practical needs. With the pivots 46 of the lamp casing 40, the lamp assembly 30 is pivotally installed in the lamp compartment 24*a* of the lamp holder housing 20.

Referring to FIG. 3, the vertical driving device 80 includes a reversible motor 81 and a pinion 82. Therein, the reversible motor 81 of the vertical driving device 80 is installed inside the machine compartment 24*b* of the lamp holder housing 20 and fixed to the partition 23 of the lamp holder housing 20. The pinion 82 of the vertical driving device 80 is driven by the reversible motor 80 and meshes with the circular rack 48 of the lamp assembly 30.

As shown in FIG. 3 and FIG. 4, when the reversible motor 81 of the vertical driving device 80 is activated, the gear-engagement movement established between the pinion 82 of the vertical driving device 80 and the circular rack 48 of the lamp assembly 30 drives the lamp assembly 30 to rotate against the pivots 46 so as to tilt up and down inside the lamp compartment 24*a* of the lamp holder housing 20, thereby achieving vertical change of the illumination angle of the LED searchlight 10.

As shown in FIG. 3, the stationary gear 26 is fixed to the supporting seat 25 and forms an immovable part of the supporting seat 25.

As shown in FIG. 3, the horizontal driving device 90 includes a reversible motor 91 and a pinion 92. Therein, the reversible motor 91 of the horizontal driving device 90 is fixed to the bottom of the machine compartment 24*b* of the lamp holder housing 20, or, fixed to the bottom of the lower half 22 of the lamp holder housing 20. The pinion 92 of the horizontal driving device 90 is driven by the reversible motor 91 and meshes with the stationary gear 26 of the supporting seat 25.

As shown in FIG. 3, the supporting seat 25 pivotally supports the lamp holder housing 20 from below. When the reversible motor 91 of the horizontal driving device 90 is activated, the gear-engagement movement established between the pinion 92 of the horizontal driving device 90 and the stationary gear 26 of the supporting seat 25 drives the lamp holder housing 20 and in turn the lamp assembly 30 a installed in the lamp compartment 24*a* to turn right or left with respect to the supporting seat 25, thereby achieving horizontal change of the illumination angle of the LED searchlight 10.

Figure 7:
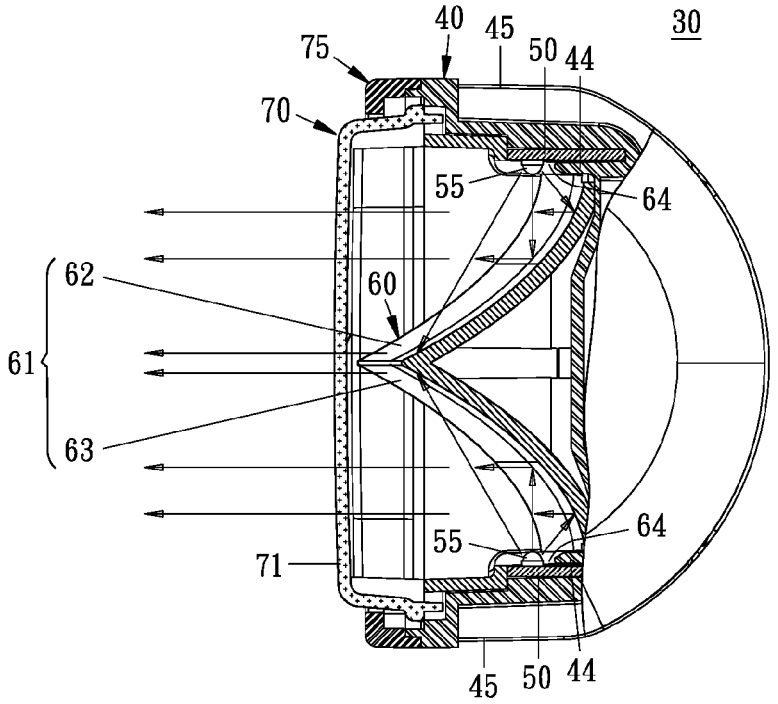
FIG. 7 is a cross-sectional view of the lamp assembly of FIG. 5.
Figure 8:
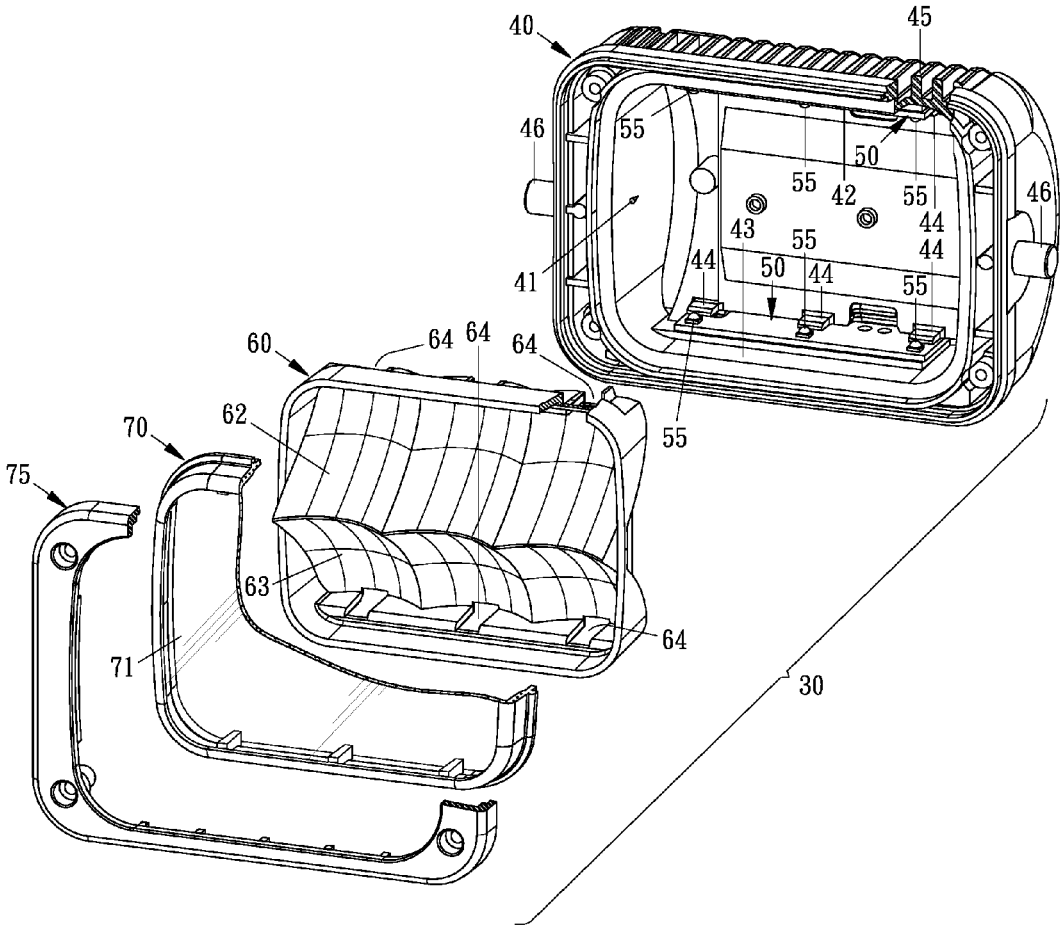
FIG. 8 is an exploded view of the lamp assembly of FIG. 5.

As shown in FIG. 7 and FIG. 8, the lamp casing 40 of the lamp assembly 30 contains therein a recess 41 for receiving the LED circuit boards 50 and the reflective lens 60.

As shown in FIG. 3 through FIG. 8, for facilitating heat dissipation, the lamp casing 40 of the lamp assembly 30 has its top and/or bottom provided with plural heat-dissipating ribs 45. Moreover, the recess 41 of the lamp casing 40 has its upper edge portion 42 and lower edge portion 43 each provided with a plurality of clamping blocks 44 for fixing the corresponding LED circuit board 50.

To assemble the lamp assembly 30, the LED circuit boards 50 are installed into the lamp casing 40 first, and then the reflective lens 60 is fitted. After installed into the lamp casing 40, the LED circuit boards 50 are close to the heat-dissipating ribs 45 formed at the top (or bottom) of the lamp casing 40, so that heat generated by the LED circuit boards 50 can be dissipated effectively.

As shown in FIG. 4 through FIG. 8, the reflective lens 60 has a surface composed of at least one set of double parabolic lens units 61. Therein, each of the double parabolic lens units 61 includes a first parabolic lens surface 62 and a second parabolic lens surface 63 that are integrated as a unity and both have concave parabolic lens surfaces for reflecting light. In addition, each said double parabolic lens unit 61 has slits 64 formed at the focuses of the first parabolic lens surface 62 and the second parabolic lens surface 63, respectively.

As shown in FIG. 4 through FIG. 7, each of the LED circuit boards 50 is provided with a plurality of LEDs 55. When the LED circuit boards 50 and the reflective lens 60 are assembled into the recess 41 of the lamp casing 40, the LEDs 55 of one of the LED circuit boards 50 are located in and exposed at the slits 64 of the first parabolic lens surfaces 62 of the double parabolic lens unit 61 of the reflective lens 60, and serve as LED light sources at the focuses of the first parabolic lens surfaces 62.

Similarly, the LEDs 55 of the other LED circuit board 50 are located in and exposed at the slits 64 of the second parabolic lens surfaces 63 of the double parabolic lens unit 61 of the reflective lens 60, and serve as LED light sources at the focuses of the second parabolic lens surfaces 63.

As shown in FIG. 7, light beams emitted from the LEDs 55 of the LED circuit board 50 are reflected by the corresponding first parabolic lens surface 62 (or second parabolic lens surface 63) of the reflective lens 60 into parallel light beams. Therefore, the disclosed lamp assembly 30 can project or emit parallel LED light beams far to the front.

As shown in FIG. 4 through FIG. 8, the lens frame 70 has a lens 71 for closing the recess 41 of the lamp casing 40. The outer frame 75 serves to enclose and hold the lens frame 70 and is fixed to the lamp casing 40. As shown in FIG. 7, after assembled, the lens 71 of the lens frame 70 extends from the outer frame 75, so that when the outer frame 75 is fixed to the lamp casing 40, the lens frame 70 and the outer frame 75 are together fixed to the lamp casing 40.

As shown in FIG. 7, after assembled, the lens 71 of the lens frame 70 allows parallel LED light beams to pass therethrough and prevent water from entering the interior of the lamp casing 40, thereby protecting the LED circuit boards 50 installed in the lamp casing 40 from moisture.

Figure 5:
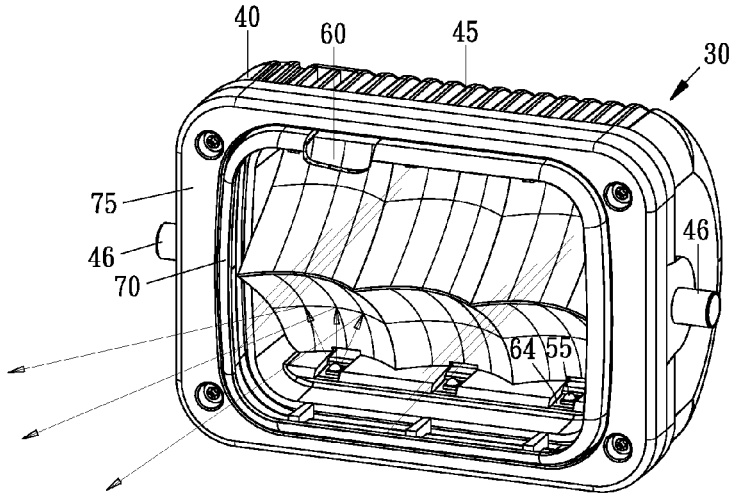
FIG. 5 is a perspective view of a lamp assembly used in the searchlight of FIG. 4.
Figure 6:
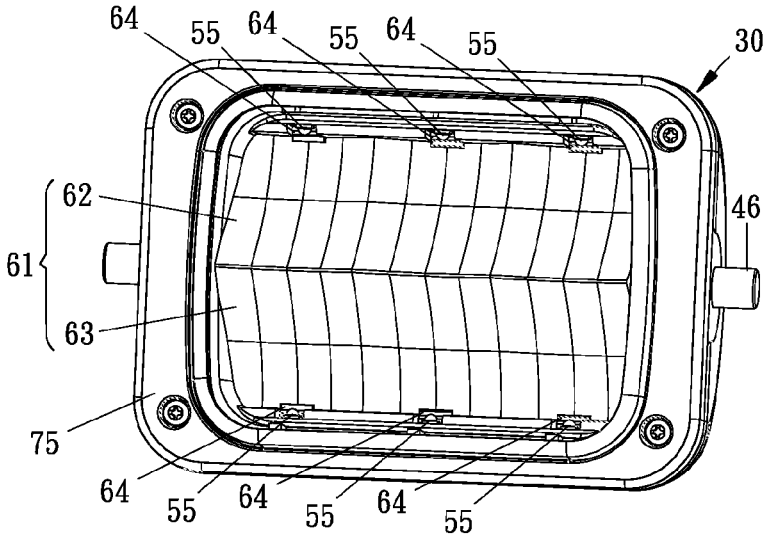
FIG. 6 is another perspective view of the lamp assembly of FIG. 5 taken from a different viewpoint.

FIG. 5 shows another embodiment of the lamp assembly 30. In the present embodiment, the lamp casing 40 is not provided with the circular rack 48. Alternatively, in still another embodiment of the lamp assembly 30, the lamp casing 40 is not laterally provided with the pivots 46. When using the lamp assembly 30 such configured, the disclosed reflective LED searchlight 10 is still effective in casting parallel LED light beams far to the front, but does not support vertical or horizontal change of its illumination angle.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An LED lamp assembly, comprising:

a lamp casing, containing therein a recess whose upper edge portion and lower edge portion are each provided with a plurality of clamping blocks;

two LED circuit boards, each provided with a plurality of LEDs, wherein one of the LED circuit board is fixed by the clamping block at the upper edge portion of the recess of the lamp casing, and the other LED circuit board is fixed by the clamping block at the lower edge portion of the recess of the lamp casing;

a reflective lens, being a concave parabolic lens surface and having at least one set of double parabolic lens units, wherein each said set of double parabolic lens unit includes a first parabolic lens surface and a second parabolic lens surface integrated as a unity, and each said set of double parabolic lens unit has a slit located at a focus of each of the first parabolic lens surface and the second parabolic lens surface, so that after assembled, each said LED of the LED circuit boards is exposed at one said slit at the corresponding double parabolic lens unit;

a lens frame, having a lens to close the recess of the lamp casing; and an outer frame, enclosing to the lens of the lens frame as well as allowing the lens frame and the outer frame being fixed to the lamp casing together.

2. The LED lamp assembly of claim 1, wherein the lamp casing has a top thereof provided with a plurality of heat-dissipating ribs.

3. The LED lamp assembly of claim 1, wherein the lamp casing has a bottom thereof provided with a plurality of heat-dissipating ribs.

4. The LED lamp assembly of claim 2, wherein the lamp casing has a bottom thereof provided with a plurality of heat-dissipating ribs.

5. A reflective LED searchlight, comprising:

a lamp holder housing in which a partition is provided to divide the lamp holder housing into a lamp compartment and a machine compartment;

a supporting seat, pivotally supporting the lamp holder housing from below and having a stationary gear;

a lamp assembly of claim 1, pivotally installed in the lamp compartment of the lamp holder housing; wherein the lamp casing of the lamp assembly has a back provided with a circular rack;

a vertical driving device, including:

a reversible motor, fixed to the partition of the lamp holder housing; and a pinion, driven by the reversible motor and meshing with the circular rack of the lamp assembly;

a horizontal driving device, including:

a reversible motor, fixed to a bottom of the machine compartment of the lamp holder housing; and a pinion, driven by the reversible motor and meshing with the stationary gear of the supporting seat.

6. The reflective LED searchlight of claim 5, wherein the lamp holder housing includes an upper half and a lower half.

7. The reflective LED searchlight of claim 5, wherein the lamp casing of the lamp assembly has a top provided with a plurality of heat-dissipating ribs.

8. The reflective LED searchlight of claim 5, wherein the lamp casing of the lamp assembly has a bottom provided with a plurality of heat-dissipating ribs.

9. The reflective LED searchlight of claim 7, wherein the lamp casing of the lamp assembly has a bottom provided with a plurality of heat-dissipating ribs.

* * * * *